US011447367B2

(12) United States Patent
Mohammed

(10) Patent No.: US 11,447,367 B2
(45) Date of Patent: Sep. 20, 2022

(54) MAGNETIC TAPE STABILIZING SYSTEMS

(71) Applicant: TK Elevator Corporation, Atlanta, GA (US)

(72) Inventor: Sami Mohammed, Cordova, TN (US)

(73) Assignee: TK Elevator Corporation, Atlanta, GA (US)

( * ) Notice: Subject to any disclaimer, the term of this patent is extended or adjusted under 35 U.S.C. 154(b) by 570 days.

(21) Appl. No.: 16/568,870

(22) Filed: Sep. 12, 2019

(65) Prior Publication Data

US 2021/0078826 A1 Mar. 18, 2021

(51) Int. Cl.
*B66B 1/50* (2006.01)
*B66B 11/00* (2006.01)
*B66B 3/02* (2006.01)

(52) U.S. Cl.
CPC ..... *B66B 1/50* (2013.01); *B66B 3/023* (2013.01); *B66B 11/0005* (2013.01)

(58) Field of Classification Search
CPC ..... B66B 1/50; B66B 3/023; B66B 11/0005; B66B 1/3492
See application file for complete search history.

(56) References Cited

U.S. PATENT DOCUMENTS

| | | | | |
|---|---|---|---|---|
| 1,920,590 | A | 8/1933 | Pedersen | |
| 3,590,177 | A | 6/1971 | Ustin et al. | |
| 4,798,267 | A | 1/1989 | Foster et al. | |
| 5,864,103 | A | 1/1999 | Koeppe, Jr. et al. | |
| 5,925,859 | A | 7/1999 | Miller | |
| 6,128,116 | A * | 10/2000 | Dobler | G01S 5/16 398/1 |
| 6,622,827 | B1 * | 9/2003 | Disieno | B66B 1/3492 187/394 |
| 7,264,090 | B2 | 9/2007 | Vecchiotti | |
| 7,669,696 | B2 | 3/2010 | Osmanbasic | |
| 8,985,281 | B2 | 3/2015 | De Coi | |
| 9,352,934 | B1 * | 5/2016 | Lee | B66B 1/3492 |
| 9,469,501 | B2 | 10/2016 | Lee | |
| 9,725,280 | B2 | 8/2017 | De Coi | |
| 2002/0104716 | A1 * | 8/2002 | Zaharia | B66B 1/3492 187/394 |
| 2015/0096844 | A1 * | 4/2015 | Lee | B66B 1/3492 187/394 |

FOREIGN PATENT DOCUMENTS

| | | | |
|---|---|---|---|
| CN | 108249245 | A | 7/2018 |
| EP | 3231753 | B | 9/2018 |

* cited by examiner

*Primary Examiner* — Jeffrey Donels
(74) *Attorney, Agent, or Firm* — William J. Cassin

(57) ABSTRACT

A stabilizing system may be utilized to reduce or eliminate sway of magnetic tape that is suspended in an elevator hoistway and provides a positional reference to an elevator cab. The stabilizing system may include a stabilizing mechanism fixed within a hoistway and a roller cam disposed on the elevator cab. The stabilizing system may include a telescoping member attached to a guide having opposing flanges that restrict movement of the tape. The telescoping member and the guide may be biased in an extended position, where the guide partially surrounds the tape. In a retracted position, the guide is horizontally spaced apart from the tape. When the elevator cab passes the stabilizing mechanism, the roller cam may force the guide and the telescoping member into the retracted position to prevent any contact between the stabilizing mechanism and components disposed on the elevator cab.

20 Claims, 10 Drawing Sheets

MAGNETIC TAPE STABILIZING SYSTEMS

FIELD

The present disclosure generally relates to elevators, including systems and mechanisms for stabilizing magnetic tape that is suspended within an elevator hoistway and that provides a reference for positions of elevator cabs.

BACKGROUND

One aspect of safely operating an elevator system requires sensing a position of an elevator cab within a hoistway and determining deceleration and stopping points. One known approach to sensing the position of the elevator cab involves causing a sensor disposed typically on a side of the elevator cab to detect magnets embedded in tape that extends between a top and a bottom of the hoistway. The tape remains vertically stationary in the hoistway and may pass through one or more guides disposed on or adjacent to the sensor on the elevator cab. Hence the elevator cab, the sensor, and the guides travel vertically in the hoistway relative to the vertically stationary tape. Each magnet embedded in the tape may produce a unique electromagnetic field. And because the tape is vertically stationary within the hoistway, an elevator controller can determine the elevator cab's position relative to various parts of the hoistway such as floor levels and door zones when the sensor detects these unique electromagnetic fields and relays that information to the elevator controller. In some cases, calibration may be required whereby the elevator controller associates each unique electromagnetic field with a specific position in the hoistway. In addition or in the alternative to magnets, the tape may contain other forms of indicia such as holes, for example, that one or more sensors disposed on the elevator cab can detect so as to identify the position of the elevator cab, as disclosed more fully in U.S. Pat. No. 4,798,267 entitled "Elevator System Having an Improved Selector," which is incorporated herein by reference in its entirety.

One problem with this approach is that the suspended tape may sway, at times considerably, within the hoistway. This problem is only exacerbated in tall buildings. The tape may sway for a variety of reasons, such as because of air pressure, wind, and/or temperature differentials in the hoistway; forces that the guides exert on the tape, which in some instances are due to friction between the guides and the tape; and so on. Swaying tape can interfere and/or become entangled with other cables and objects in the hoistway. Tape may sway even more if tension on the tape is loose. Swaying tape can even become dislodged from the guides on the elevator cab, particularly where the tape is entangled with a nearby object as the guides and the sensor on the elevator cab approach. For example, tape that sways can become entangled with or stick to magnetic objects; electrical boxes; and/or traveling cables such as electrical, communication, governor, and/or counterweight cables.

Thus a need exists for systems and mechanisms that stabilize tape suspended within a hoistway and prevent such tape from interfering and/or becoming entangled with other objects and traveling cables in the hoistway.

SUMMARY

An example stabilizing system may include a stabilizing mechanism that can be fixed in an elevator hoistway and a roller cam that can be fixed on an elevator cab. The stabilizing mechanism may include a telescoping member, a mount for the telescoping member, and a guide attached to the telescoping member. The guide and the telescoping member may be positionable in a retracted position and in an extended position relative to the mount. The guide may be biased in the extended position so as to partially surround and stabilize tape that is suspended in the hoistway. The tape may have magnets or other indicia that serve as positional references to a sensor disposed on the elevator cab. Further, the roller cam may force the guide and the telescoping member from the extended position into the retracted position when the roller cam engages with the stabilizing mechanism. Such engagement may occur when the elevator cab passes the stabilizing mechanism in the hoistway. Furthermore, in the retracted position, the guide is spaced horizontally apart from the tape and, in some cases, a plumb line of the tape too.

In some examples, the mount may comprise a first tube, and the telescoping member may comprise a second tube. The second tube may be positioned at least partially within the first tube. Thus the first and second tubes may be concentric. A spring may force the second tube away from the first tube, thus biasing the second tube into the extended position when the stabilizing mechanism and the roller cam are disengaged.

Some example roller cams may have an upper portion, a central portion, and a lower portion. The central portion may extend vertically alongside the elevator cab, and the upper and lower portions may be oriented at obtuse angles relative to the central portion. To prevent any contact between the roller cam and the tape, the roller cam may have open-ended slots at its top and bottom through which the tape may pass.

In addition, one or more tape guides may be disposed adjacent to or on the sensor on the elevator cab. The tape guides may guide the tape across the sensor. Typically, the sensor is disposed between the elevator cab and the roller cam such that the roller cam protects the sensor from the stabilizing mechanism as the elevator cab, sensor, tape guides, and the roller cam pass the stabilizing mechanism in the hoistway. In some instances, the tape guides may be spaced horizontally apart from the plumb line of the tape.

Moreover, in some examples the guide may comprise a U-shaped channel that has two opposing flanges. The flanges may be connected by a planar member. The flanges and the planar member may limit sway of the tape within the hoistway. The stabilizing mechanism may further include in some cases one or more cams that are disposed on the guide. The cam(s) may roll along the roller cam when the stabilizing mechanism and the roller cam are engaged. The cams may be positioned on external sides of the two opposing flanges.

The stabilizing mechanism may be secured to a sidewall of the hoistway or to a beam in the hoistway, for example, by way of an adjustable support. The adjustable support may be attached to the stabilizing mechanism with one or more fasteners that extend through one or more slotted apertures. Fixing the stabilizing mechanism within the hoistway in this manner permits adjustment of the position of the stabilizing mechanism so that the stabilizing mechanism can be positioned optimally with respect to the suspended tape.

In some examples, the stabilizing mechanism may include means for selectively moving the telescoping member between the retracted position and the extended position without any need for a roller cam. For instance, the stabilizing mechanism may include a solenoid that is capable of rapidly moving the telescoping member and the guide between the retracted and extended positions. The means may be configured to move the telescoping member into the retracted position when the elevator cab passes the stabilizing mechanism. In such examples, one or more sensors may be utilized to determine proximity of the elevator cab relative to the stabilizing mechanism.

DETAILED DESCRIPTION

Although certain example methods and apparatuses are described herein, the scope of coverage of this patent is not limited thereto. On the contrary, this patent covers all methods, apparatuses, and articles of manufacture fairly falling within the scope of the appended claims either literally or under the doctrine of equivalents. Moreover, those having ordinary skill in the art will understand that reciting "a" element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claim need not necessarily be performed in the order in which they are recited, unless so required by the context of the claims. In addition, all references to one skilled in the art shall be understood to refer to one having ordinary skill in the art. With respect to the drawings, it should be understood that not all components are drawn to scale. Furthermore, those having ordinary skill in the art will understand that the various examples disclosed herein should not be considered in isolation. Rather, those with ordinary skill in the art will readily understand that the disclosure relating to some examples may be combined with and/or equally applicable to the disclosure relating to other examples.

Figure 1:
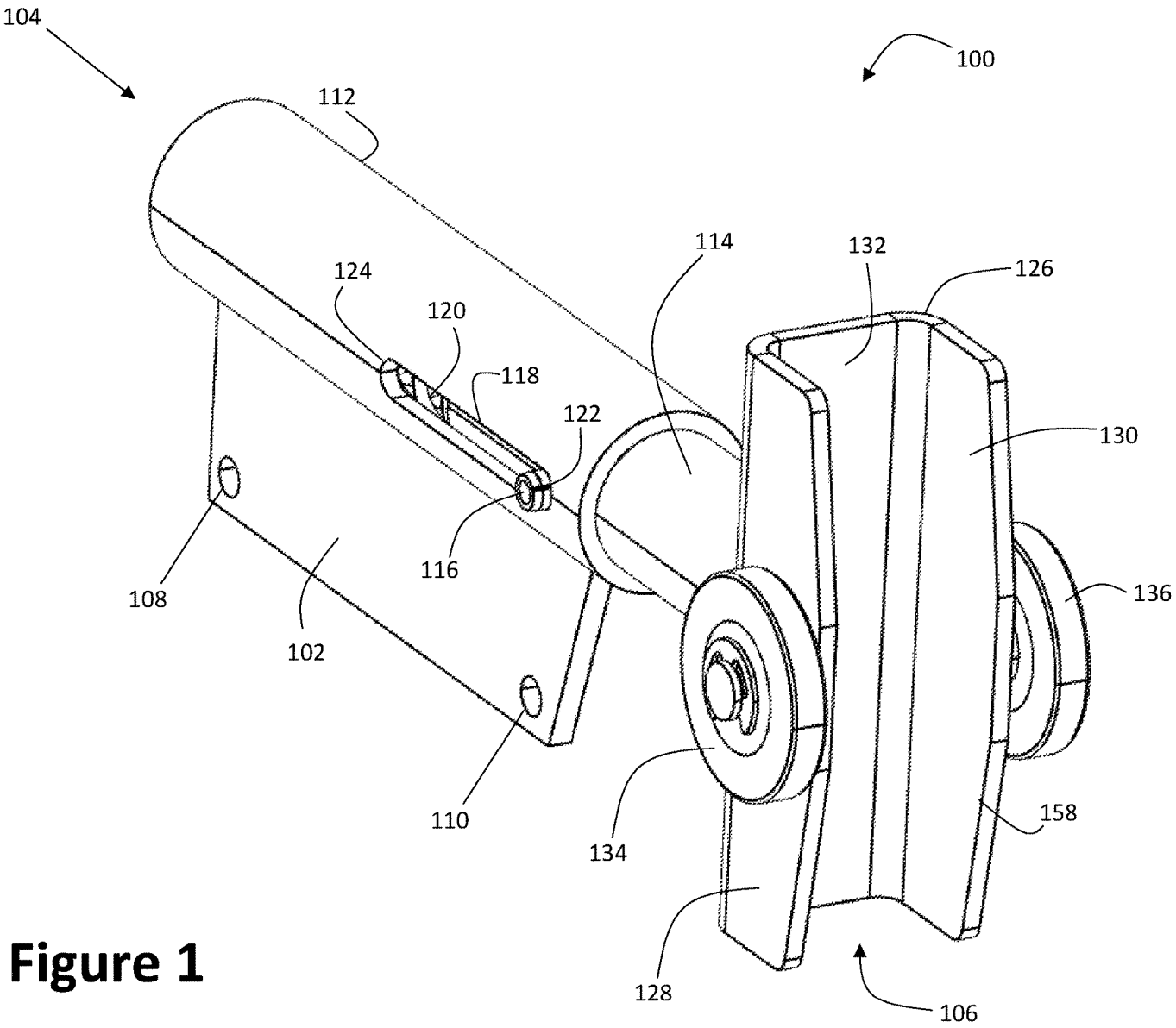
FIG. 1 is a perspective view of an example stabilizing mechanism that can be fixed within an elevator hoistway.
Figure 2:
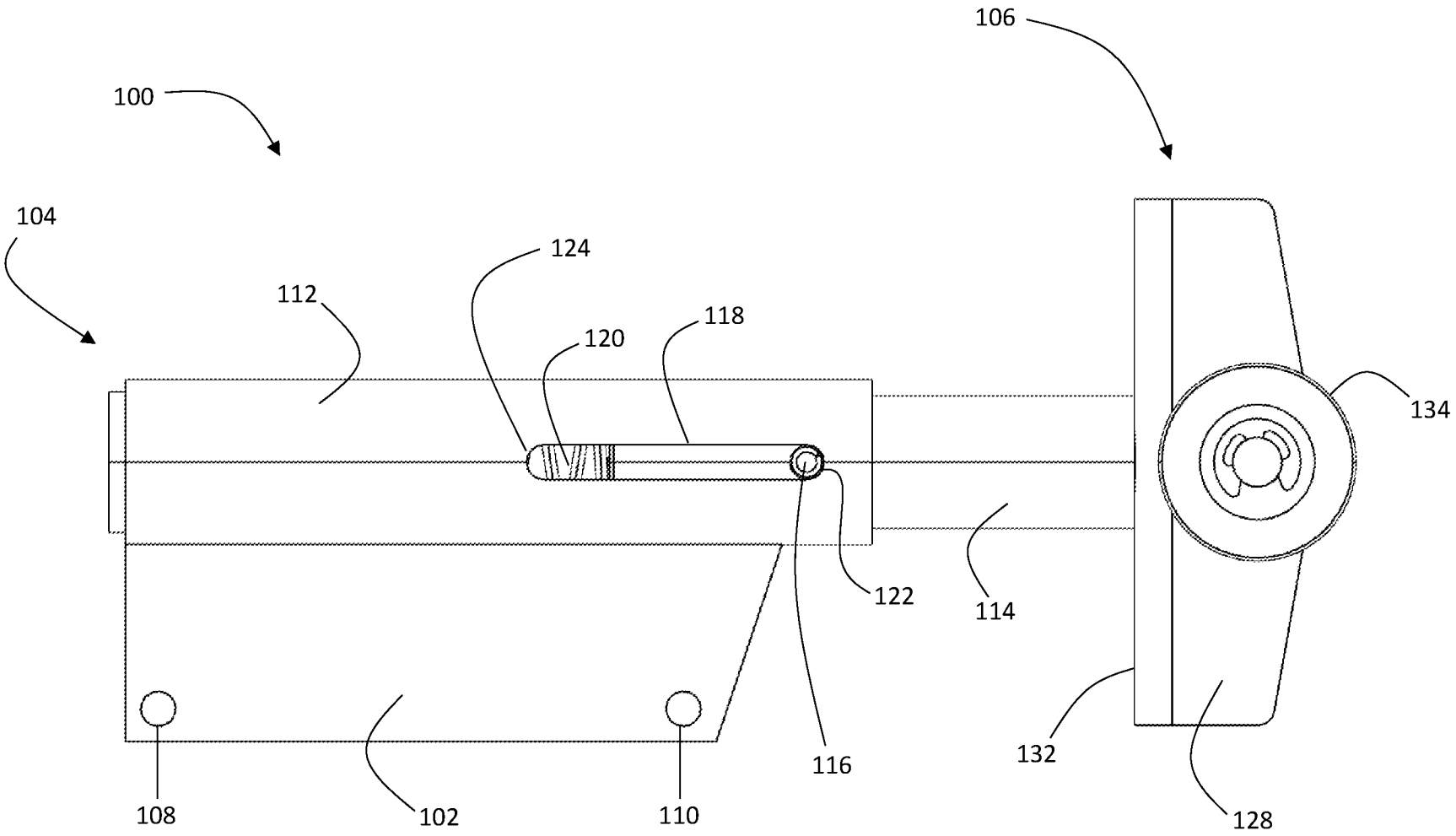
FIG. 2 is a side view of the example stabilizing mechanism shown in FIG. 1.

FIGS. 1 and 2 show an example stabilizing mechanism 100 that can be used to stabilize tape suspended within an elevator hoistway. The example stabilizing mechanism 100 may be one of numerous components in some stabilizing systems. These stabilizing systems may be installed during installation of an elevator system or retroactively, long after installation of the elevator system. The term "tape" should be understood broadly so as to encompass without limitation an elongate member having a ribbon-like structure; an elongate member having a flexible, braided structure; a cable; a rope; a string; a line; a wire; a cord; and/or the like. The stabilizing mechanism 100 may generally comprise a base 102, a telescoping assembly 104, and a guide 106. The base 102 may include apertures 108, 110 for securing the stabilizing mechanism 100 within an elevator hoistway. The base 102 may be welded, fastened, or otherwise attached to the telescoping assembly 104 so as to support the telescoping assembly 104. Alternatively, the base 102 may be integrally formed with at least part of the telescoping assembly 104.

The telescoping assembly 104 may include a first tube 112 that is attached to the base 102. The telescoping assembly 104 may also include a second tube 114 that is configured to translate relative to the first tube 112. The first and second tubes 112, 114 shown in the figures are cylindrical with a circular cross-section, but are not so limited and may have different cross-sections in other examples such as rectangular, square, triangular, or elliptical, for instance. The example second tube 114 shown in FIGS. 1 and 2 may be disposed at least partially within the first example tube 112 such that the first and second tubes 112, 114 are concentric and partially overlapping. In other words, an outer diameter of the second tube 114 may be smaller than an inner diameter of the first tube 112. A pin 116 attached to the second tube 114 may protrude into one or more slots 118 in the first tube 112. In some examples, the slots 118 may simply be grooves carved into an inner surface of the first tube 112. In the example telescoping assembly 104 in FIGS. 1 and 2, though, the slots 118 are elongated through-holes in the first tube 112. Allowing the pin 116 attached to the second tube 114 to travel along the slots 118 in the first tube 112 both guides and limits translational movement of the second tube 114 relative to the first tube 112.

A spring 120 may be compressed and housed within the first tube 112 in a manner such that the spring 120 pushes the second tube 114 away from the first tube 112. In a similar vein, the telescoping assembly 104 may be configured via the spring 120 to force the second tube 114 at least partially out of the first tube 112 into an extended position when external forces are not acting on the telescoping assembly 104, as in FIGS. 1 and 2. However, engagement between the pin 116 and a first end 122 of the slot 118 limits the translational movement between the first and second tubes 112, 114 as well as the ultimate position of the second tube 114, preventing the second tube 114 from being ejected from the first tube 112. Conversely, when external forces act on the second tube 114 and force the second tube 114 back into the first tube 112 and into a retracted position whereby the spring 120 is compressed, as will be explained below, a second end 124 of the slot 118 limits the translational movement between the first and second tubes 112, 114 as well as the ultimate position of the second tube 114.

In general, though, the first tube 112 is merely one example type of "mount" for the second tube 114, which operates as a "telescoping member." Those having ordinary skill in the art will appreciate that the present disclosure contemplates a multitude of variations to this example telescoping assembly 104. For instance, other example telescoping assemblies may include more than one or two slots and more than one pin. Similarly, other example telescoping assemblies may involve a mount and a telescoping member disposed side-by-side, as opposed to concentrically.

The guide 106 may be formed integrally with the telescoping member (i.e., the second tube 114 in this example) or may be attached to the telescoping member by way of a weld, a fastener, or other attachment. Moreover, the guide 106 may be configured to receive tape that is suspended in the hoistway. For instance, in some cases the guide 106 may be, for example and without limitation, a V-shaped channel or a U-shaped channel 126 as shown in FIG. 1. At least in examples where the guide 106 is configured as the U-shaped channel 126, the guide 106 may include a first flange 128 and a second flange 130 that oppose one another and are connected by a planar member 132. In the example depicted in FIGS. 1 and 2, the guide 106 is oriented such that a longitudinal extent of the guide 106 extends vertically or generally vertically (e.g., ±5°) within the hoistway. In still other examples, however, the guide 106 may be considerably shorter such that a diameter of first and second cams 134, 136 disposed on, respectively, the first and second flanges 128, 130 is larger than a height of the U-shaped channel. Those having ordinary skill in the art will understand that the first and second cams 134, 136 may also be regarded by other names, such as "wheels," for example.

Figure 3:
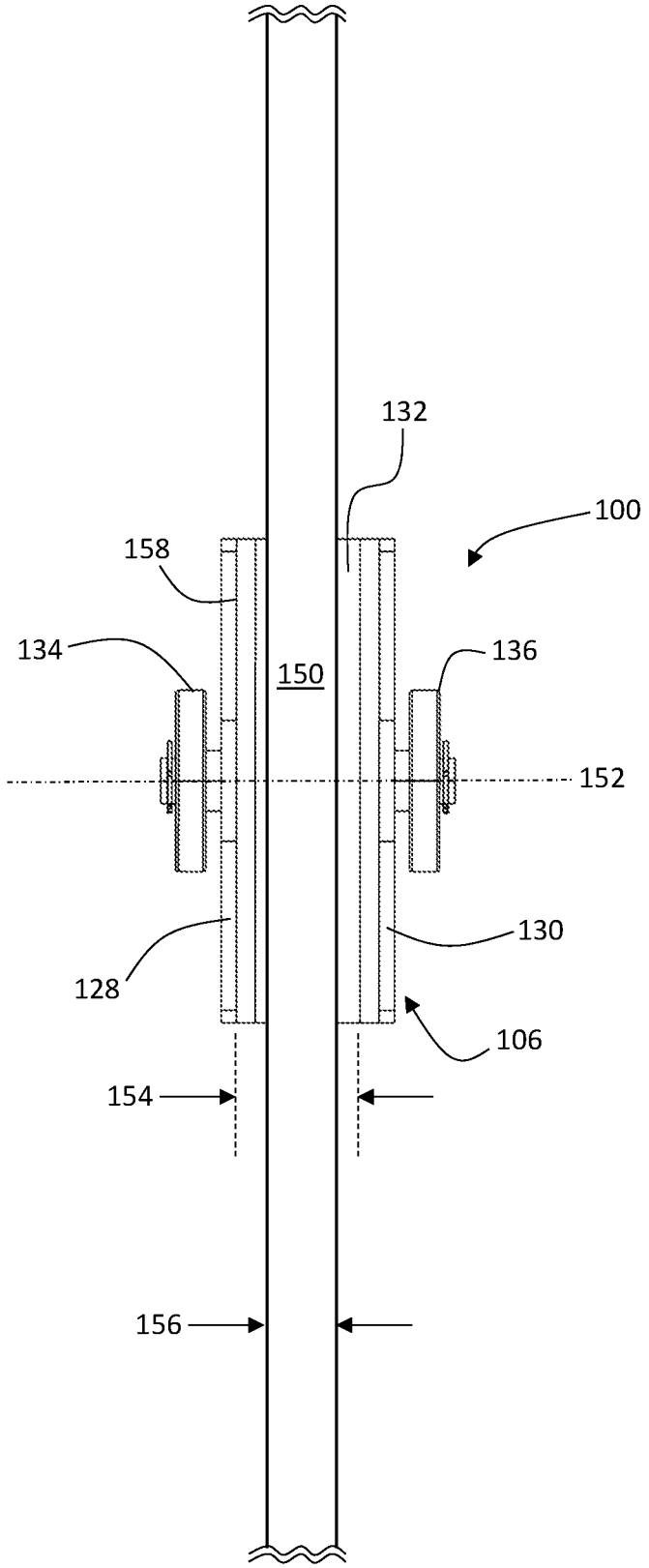
FIG. 3 is a front view of the example stabilizing mechanism shown in FIGS. 1 and 2, along with a segment of tape disposed in and guided by a channel of the stabilizing mechanism.

Referring now to FIG. 3, the guide 106 may be configured to, at times, partially surround a segment of tape 150 that extends vertically in a hoistway. By partially surrounding the tape 150, the first and second flanges 128, 130 of the guide 106 prevent or at least significantly limit sway of the tape 150 primarily transversely with respect to the guide 106. With respect to the example guide 106 shown in FIGS. 1-3, transversely may be defined based on a transverse axis 152 extending between the first and second cams 134, 136 and/or extending between and normal to the first and second flanges 128, 130. Still another way to describe what is meant by transverse is normal to a longitudinal extent of the tape 150 and coplanar with the tape 150. However, the planar member 132 of the guide 106 may also prevent or at least significantly limit sway of the tape 150 towards beams, sidewalls, and other fixed structures within the hoistway to which the stabilizing mechanism 100 may be attached. In some examples a width 154 of the planar member 132 (i.e., as measured between inner/opposing faces of the first and second flanges 128, 130) may be 125%, 135%, 150%, 175%, 200%, 250%, 300%, or 400% of a width 156 of the tape 150 that extends vertically throughout the hoistway. Further, one or more edges 158 of the guide 106 may be radiused to prevent the guide 106 from lacerating the tape 150 as the tape 150 engages and disengages with the guide 106. Those having ordinary skill in the art will appreciate that in some examples the stabilizing mechanism 100, or at least the guide 106 and/or the second tube 114 of the stabilizing mechanism 100, may be composed exclusively of non-metallic components to avoid interfering with one or more sensors disposed on an elevator cab that detect magnets of the tape 150.

Figure 4:
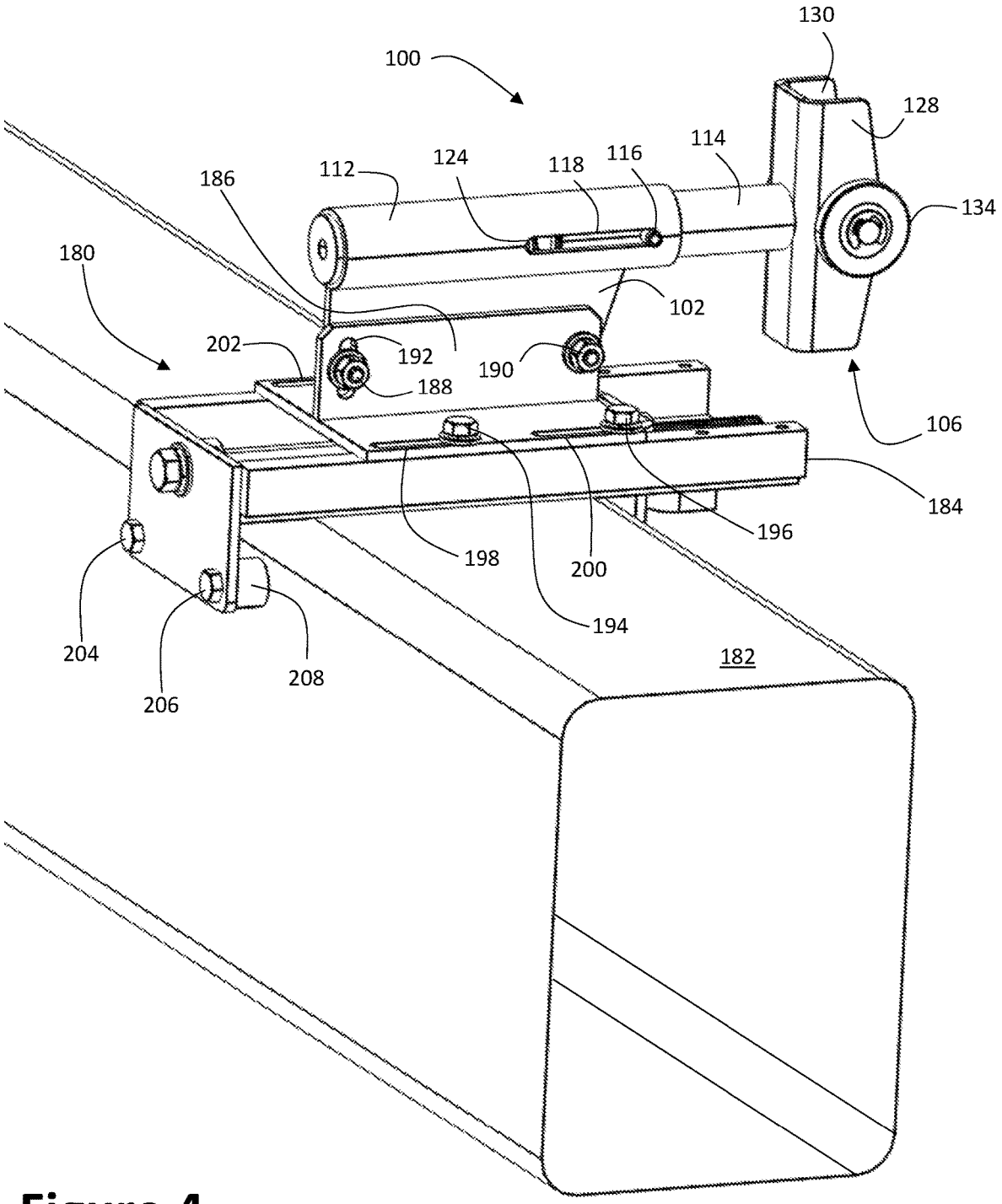
FIG. 4 is a perspective view depicting one example way in which the example stabilizing mechanism of FIGS. 1-3 may be secured to a beam within an elevator hoistway.

FIG. 4 illustrates one example way in which the stabilizing mechanism 100 may be disposed within a hoistway. Here, the example stabilizing mechanism 100 is attached via an adjustable support 180 to a beam 182 that is fixed within the hoistway. In some examples, the adjustable support 180 may include a first member 184 that is attached to the beam 182 and a second member 186 that attaches the first member 184 to the base 102 of the stabilizing mechanism 100. It should be understood that the adjustable support 180 may be configured so as to permit the guide 106 of the stabilizing mechanism 100 to be adjusted in three coordinate directions. The adjustable support 180 may even be configured so as to permit adjustability of a pitch of the guide 106 relative to the tape 150, which may be particularly advantageous depending on the height of the beam 182 within the hoistway and/or if the beam 182 is not disposed at a right angle relative to the tape 150. Such adjustability permits the stabilizing mechanism 100 and its guide 106 to be positioned at an ideal location relative to a position of the tape 150.

To this end, the base 102 of the stabilizing mechanism 100 may be attached to the second member 186 of the adjustable support 180 with fasteners 188, 190 that extend through the apertures 108, 110 of the base 102. At least one aperture 192 of the second member 186 may be slotted to permit pitch adjustment of the stabilizing mechanism 100. In other examples, an aperture on the second member 186 that receives the fastener 190 may also, or instead, be slotted. Using multiple slotted apertures in the second member 186 and/or the base 102 permits adjustment of a height and a pitch of the stabilizing mechanism 100. Fasteners 194, 196 may also be used to attach the second member 186 to the first member 184 of the adjustable support 180. Slotted apertures 198, 200, 202 may receive the fasteners 194, 196 for purposes of attaching the first and second members 184, 186. The slotted apertures 198, 200, 202 may extend parallel to a longitudinal extent of the first and second tubes 112, 114 to enable adjustment of the stabilizing mechanism 100 to and from the tape 150. Similarly, fasteners 204, 206 may also be used to attach the adjustable support 180 to the beam 182. In some cases, bushings 208 may be used to clamp the beam 182 as opposed to having the fasteners 204, 206 pass through apertures in the beam 182. Consequently, the adjustable support 180 may be adjustably positioned along a length of the beam 182 based on the position of the tape 150.

Those having ordinary skill in the art will recognize that the present disclosure contemplates a wide variety of ways in which to adjustably attach the stabilizing mechanism 100 to the beam 182, a sidewall of the hoistway, or other structure. Hence it should be understood that the approach illustrated in FIG. 4 with the adjustable support 180 is non-limiting and is purely illustrative.

Figure 5A:
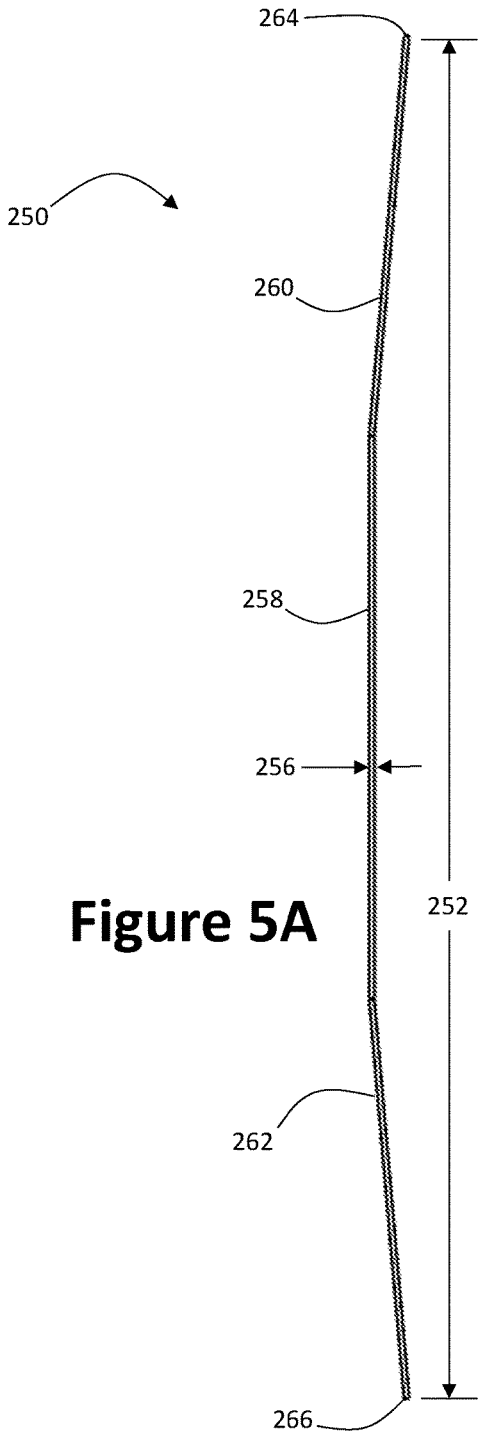
FIG. 5A is a side view of an example roller cam.
Figure 5B:
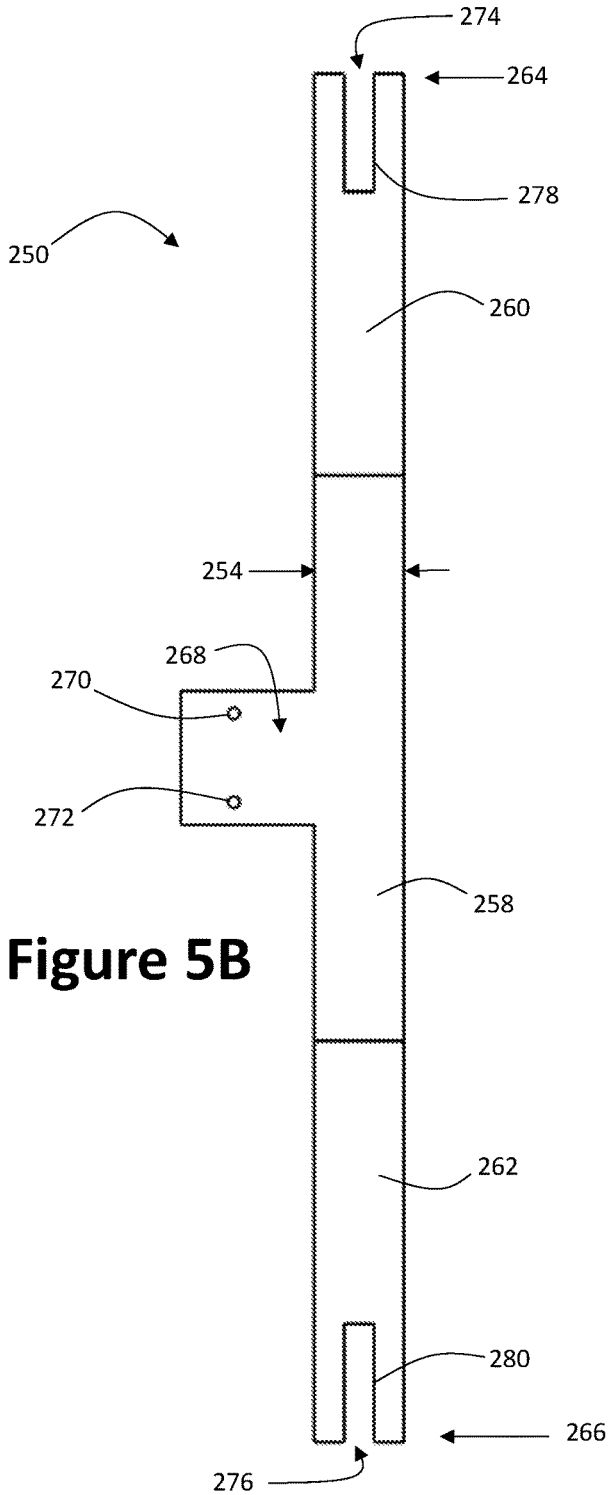
FIG. 5B is a front view of the example roller cam of FIG. 5A.

Turning now to another component of some example stabilizing systems, FIGS. 5A and 5B depict one example roller cam 250. The roller cam 250 in some examples is disposed on or at an elevator cab. Further, the roller cam 250 may at times engage with the first and second cams 134, 136 of the stabilizing mechanism 100, as explained below. The roller cam 250 may be said to have a height 252, a width 254, and a thickness 256. The roller cam 250 may generally comprise a central portion 258, an upper portion 260 that is connected to and disposed above the central portion 258, and a lower portion 262 that is connected to and disposed below the central portion 258. In the example of FIGS. 5A and 5B, the central portion 258 extends vertically, and the upper and lower portions 260, 262 are disposed at obtuse angles relative to the central portion 258. In other examples, though, the roller cam 250 may have continuous curvature over its height 252. Furthermore, the width 254 of the roller cam 250 may generally correspond to the spacing of the first and second cams 134, 136 of the stabilizing mechanism 100. In other words, the roller cam 250 should be wide enough such that the first and second cams 134, 136 can roll along the roller cam 250 between a top 264 and a bottom 266 of the roller cam 250 without disengaging to one side of the roller cam 250.

Still further, the roller cam 250 may include a flange 268 with apertures 270, 272 for attachment to an elevator cab.

The top 264 and/or bottom 266 of the roller cam 250 may include open-ended slots 274, 276 to prevent contact between the tape 150 and the roller cam 250, as will be described below in connection with FIGS. 6-8. Furthermore, edges 278, 280 of the open-ended slots 274, 276 may be radiused to prevent the edges 278, 280 from lacerating the tape 150 in the event of incidental contact.

Figure 6:
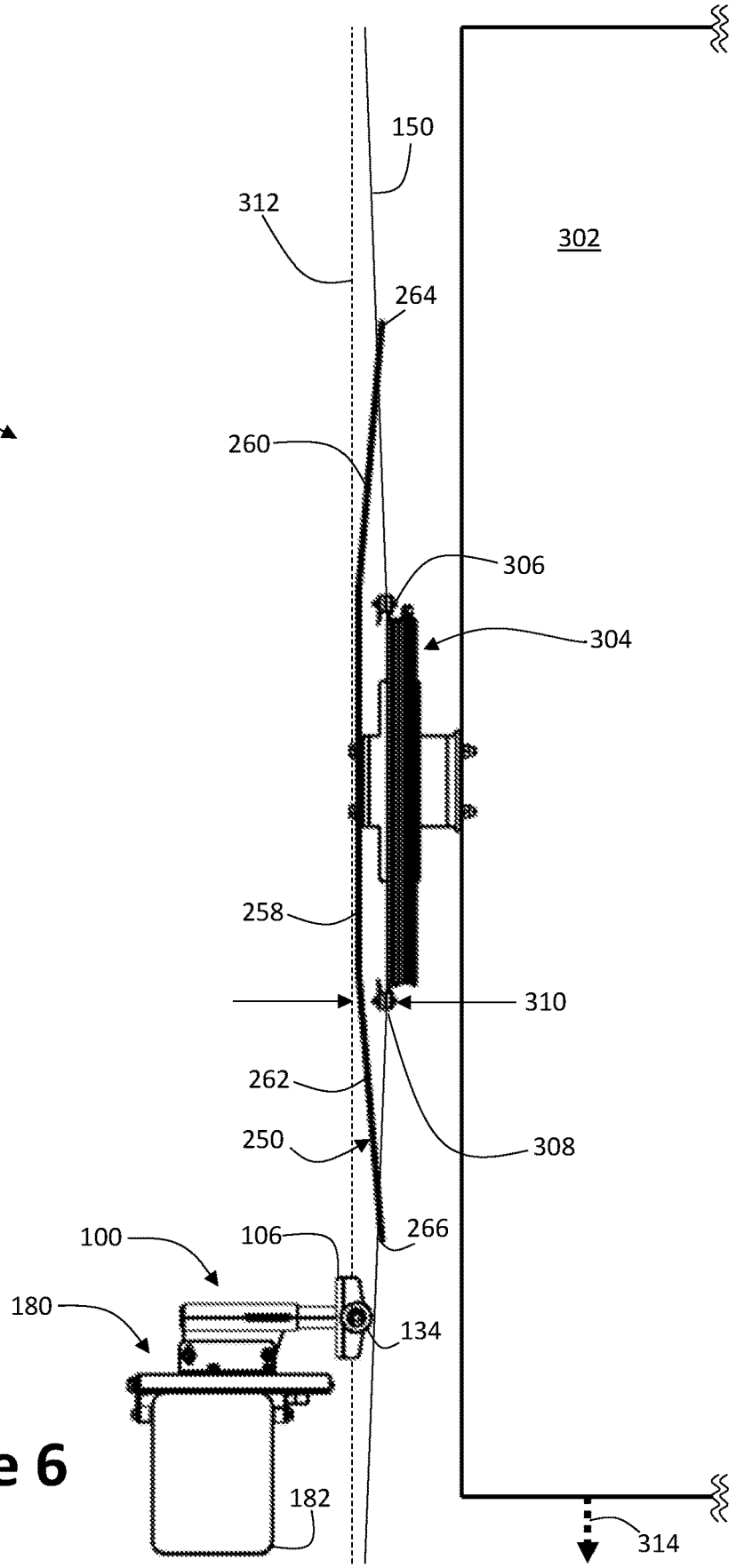
FIG. 6 is a side schematic view of an example stabilizing system for stabilizing tape that is suspended in an elevator hoistway, with an elevator cab depicted in a first position.
Figure 7:
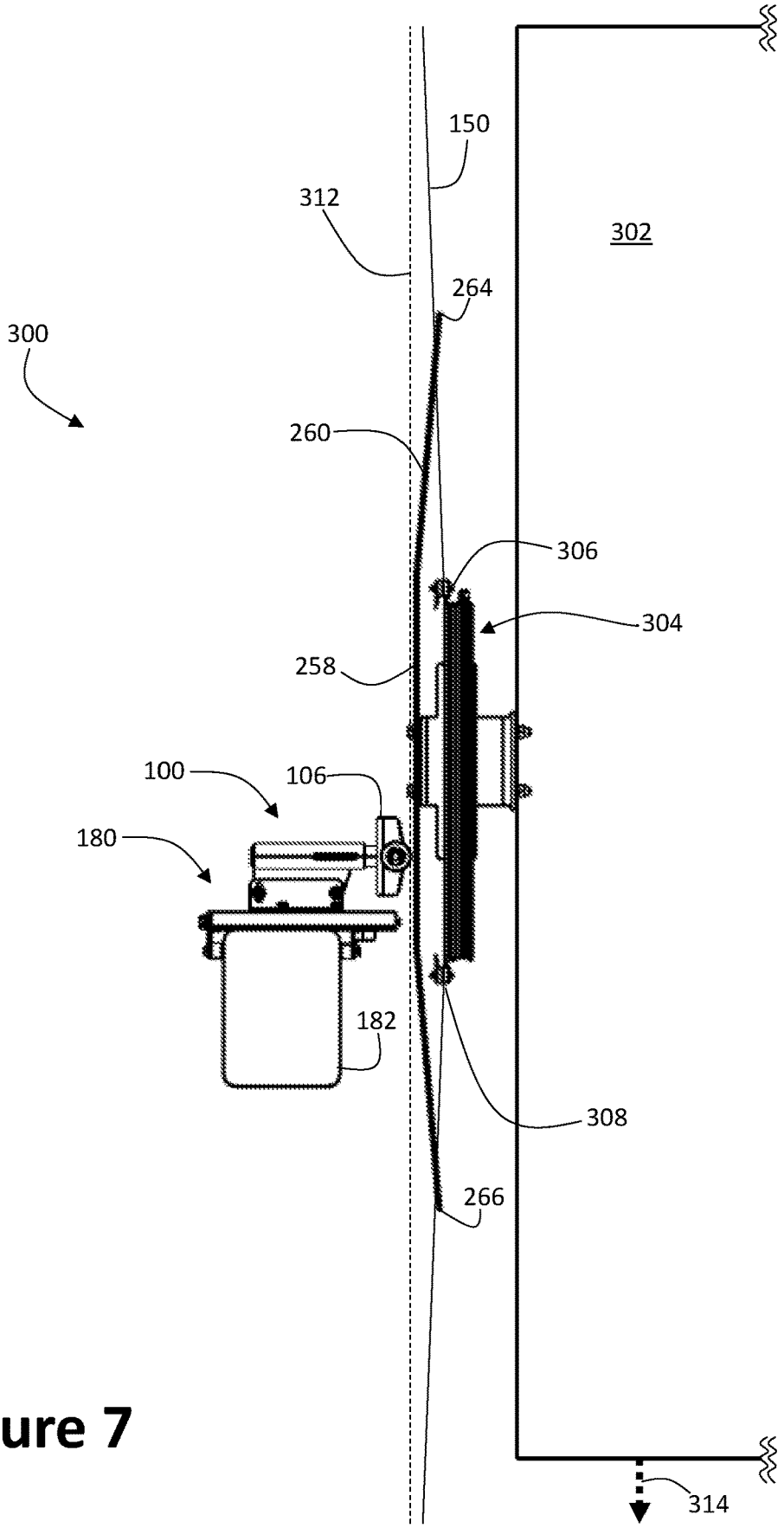
FIG. 7 is a side schematic view of the example stabilizing system of FIG. 6, with the elevator cab depicted in a second position that is below the first position shown in FIG. 6.
Figure 8:
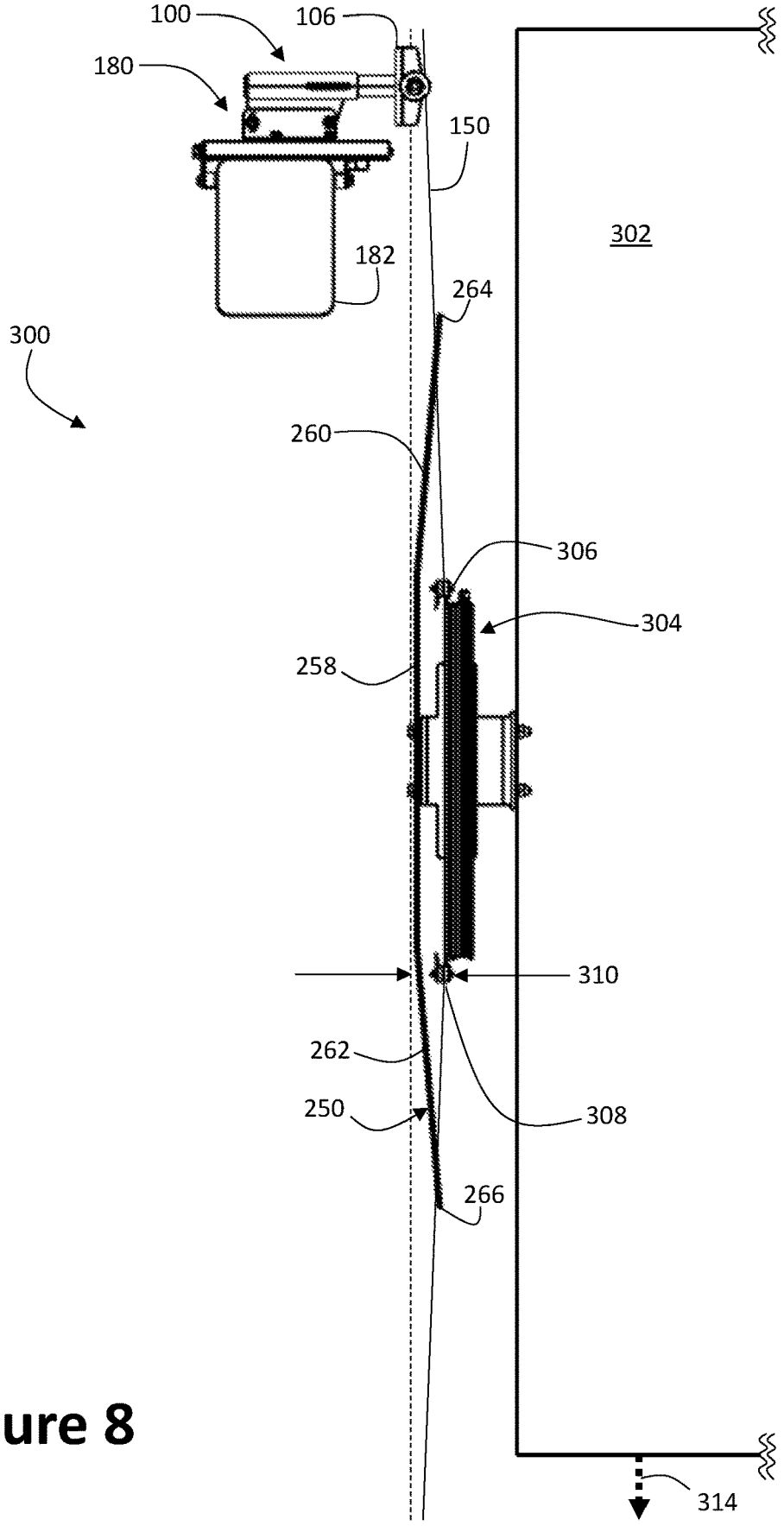
FIG. 8 is a side schematic view of the example stabilizing system of FIGS. 6 and 7, with the elevator cab depicted in a third position that is below both the first and second positions shown, respectively, in FIGS. 6 and 7.

FIGS. 6-8 illustrate an example stabilizing system 300, of which the example stabilizing mechanism 100 and the example roller cam 250 are parts. The roller cam 250 may be disposed on an elevator cab 302 adjacent to a sensor 304 that detects magnets or other indicia disposed on the tape 150. It is worth nothing again here that the example components shown in the figures are not necessarily to scale. For instance, in some examples the roller cam 250 is about two feet tall whereas the elevator cab 302 is eight to ten feet tall.

In any event, the tape 150 may be routed so as to pass through one or more tape guides 306, 308 that are disposed adjacent to the sensor 304. The upper/lower or first/second tape guides 306, 308 may in some cases be attached to the sensor 304 and/or to the elevator cab 302 directly. The tape guides 306, 308 may align the tape 150 so that the magnets or other indicia on the tape 150 may be detected by the sensor 304. In this example, the elevator cab 302, the sensor 304, the roller cam 250, and the tape guides 306, 308 can travel up and down in a hoistway relative to the beam 182, the stabilizing mechanism 100, and the tape 150, which are fixed within the hoistway, with the tape 150 being vertically fixed. Nevertheless, one having ordinary skill in the art will appreciate how in other examples certain components of a stabilizing system may be swapped so as to cause a stabilizing mechanism to move up and down with an elevator cab relative to vertically-fixed tape.

Furthermore, it should be understood that in some cases, as shown in FIGS. 6-8, a horizontal gap 310 exists between a plumb line 312 of the tape 150 and the tape guides 306, 308. In one example, the horizontal gap 310 may be about 1.25 inches, although this number may vary considerably. Tension may be maintained at least to some degree in the tape 150 by securing a weight to the tape 150 at a bottom of the hoistway. Nevertheless, due to the horizontal gap 310 between the plumb line 312 of the tape 150 and the tape guides 306, 308, the tape guides 306, 308 in effect pull the tape 150 away from the stabilizing mechanism 100. The pulling is more pronounced as the sensor 304, the tape guides 306, 308, and the elevator cab 302 approach the stabilizing mechanism 100. FIGS. 6-8 demonstrate this effect in that the tape 150 and the plumb line 312 of the tape 150 are not parallel and in that the tape 150 has been pulled out of the guide 106 with the guide 106 in close proximity to the tape guides 306, 308. In some cases, however, it should be understood that the stabilizing mechanism 100 may be positioned so that the plumb line 312 of the tape 150 extends through the guide 106.

In the sequence shown in FIGS. 6-8, the elevator cab 302, the sensor 304, the tape guides 306, 308, and the roller cam 250 are shown to be moving downwards, as indicated by a down arrow 314. More specifically, the elevator cab 302, the sensor 304, the tape guides 306, 308, and the roller cam 250 are moving downwards relative to the tape 150, the stabilizing mechanism 100, and the beam 182. In FIG. 6, the sensor 304 and the tape guides 306, 308 are approaching the stabilizing mechanism 100 from above. Because of the horizontal gap 310 and because of the proximity between the stabilizing mechanism 100 and the lower tape guide 308, the lower tape guide 308 has caused the tape 150 to emerge from the guide 106 so that the tape is no longer partially surrounded by the guide 106. At this point, the stabilizing mechanism 100 is still in the extended position, with the telescoping member (i.e., the "second tube 114" in this example) and the guide 106 fully extended from the mount (i.e., the "first tube 112" in this example). Moreover, the tape 150 is shown to be passing through the slot 276 towards the bottom 266 of the roller cam 250. In other examples, the tape 150 does not necessarily pass through the slot 276, but simply clears the bottom 266 of the roller cam 250.

At some point between the stages depicted in FIGS. 6 and 7, the lower portion 262 of the roller cam 250, which is moving downwards, will engage the first and second cams 134, 136 attached to the guide 106. To prevent contact between the sensor 304 and the stabilizing mechanism 100, the roller cam 250 via the cams 134, 136 will force the guide 106 and the telescoping member (i.e., the "second tube 114" in this example) from the extended position towards the mount (i.e., the "first tube 112" in this example) and into or at least towards a retracted position as shown in FIG. 7, as the cams 134, 136 "ride" along the roller cam 250. It should be understood that the roller cam 250 does not necessarily always force the guide 106 and the telescoping member completely into the retracted position. Alternatively, the retracted position may be understood to mean something other than the extended position, as in the retracted position does not necessarily require that the pin 116 be pressed against the end 124 of the slot 118. In any event, the force of the spring 120 will be overcome at least to some degree in the retracted position, and the spring 120 will compress. As the roller cam 250 continues downward and the cams 134, 136 begin to engage with the upper portion 260 of the roller cam, the spring 120 forces the telescoping member and the guide 106 away from the mount, causing the stabilizing mechanism 100 to return to the extended position.

In FIG. 8, the roller cam 250 is shown to have traveled to a position lower in the hoistway than the stabilizing mechanism 100. As the upper tape guide 306 continues downward and becomes less proximate to the guide 106, the segment of the tape 150 adjacent to the guide 106 moves back toward the guide 106, on its way to once again being partially surrounded by and thus stabilized by the guide 106.

One having ordinary skill in the art will understand how the example stabilizing system 300 will operate when the elevator cab 302 is traveling upwards rather than downwards. And although the example stabilizing system 300 is only depicted here with one stabilizing mechanism 100, it should be understood that numerous stabilizing mechanisms may be disposed as needed throughout the hoistway. What's more, to maximize the impact of such stabilizing mechanisms, the stabilizing mechanisms may be positioned at anti-nodes of a wave pattern characteristic of sway of the tape 150 in the hoistway. The locations of such anti-nodes may depend on various factors such as, for instance, the height of a building in which a stabilizing system is installed.

Figure 9:
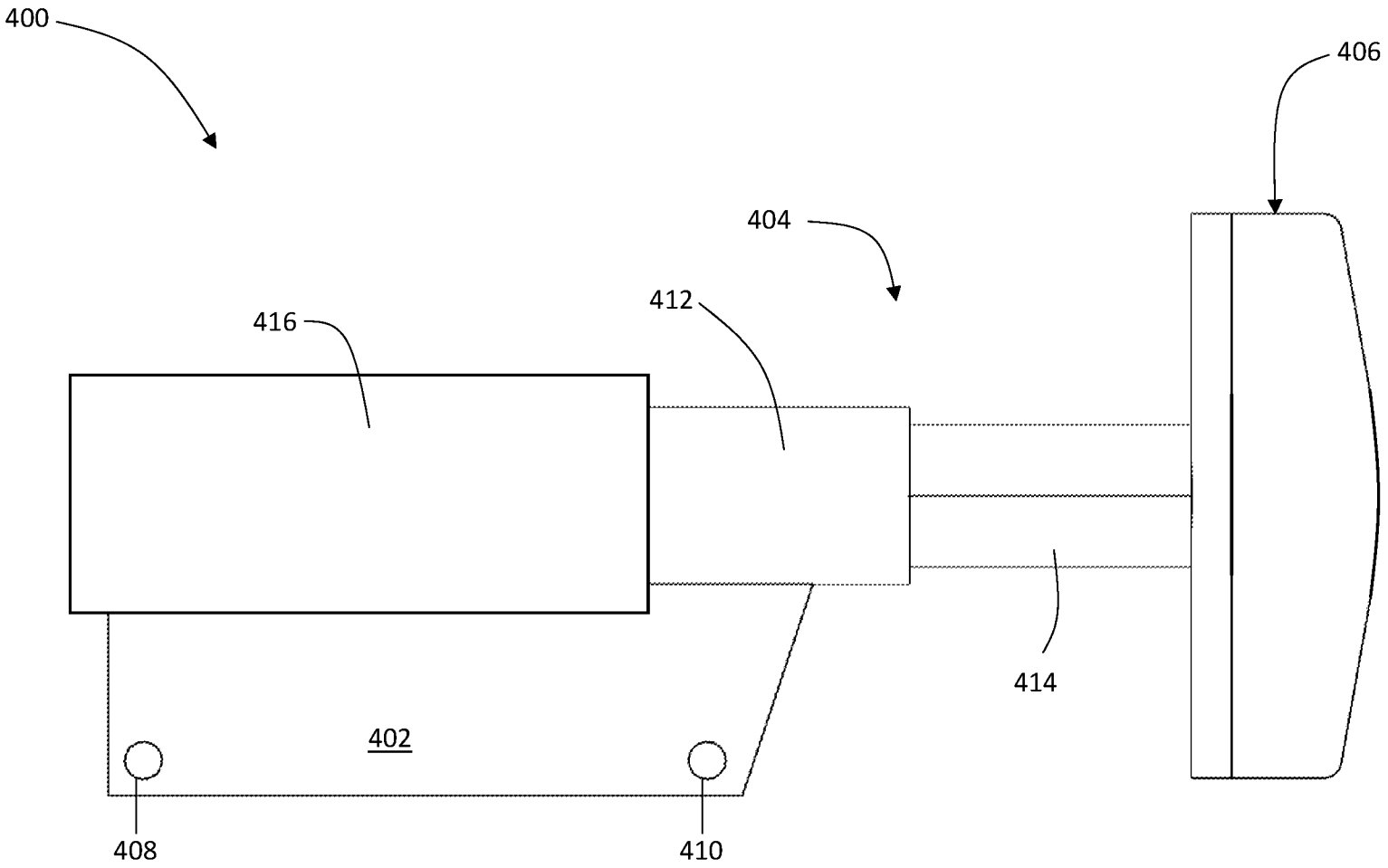
FIG. 9 is a side schematic view of another example stabilizing mechanism.

FIG. 9 illustrates still another example stabilizing mechanism 400 that can be used to stabilize tape suspended within an elevator hoistway. The example stabilizing mechanism 400 may be one of numerous components in some stabilizing systems. Similar to the example stabilizing mechanism 100, the example stabilizing mechanism 400 may generally comprise a base 402, a telescoping assembly 404, and a guide 406. The base 402 may include apertures 408, 410 for securing the stabilizing mechanism 400 within an elevator hoistway. The base 402 may be welded, fastened, or otherwise attached to the telescoping assembly 404 so as to support the telescoping assembly 404. Alternatively, the base 402 may be integrally formed with at least part of the telescoping assembly 404. The telescoping assembly 404 may include a mount 412 that is attached to the base 402. The telescoping assembly 404 may also include a telescoping member 414 that is configured to translate relative to the mount 412. The example telescoping member 414 shown in FIGS. 9 and 10 may be disposed at least partially within the mount 412.

Figure 10:
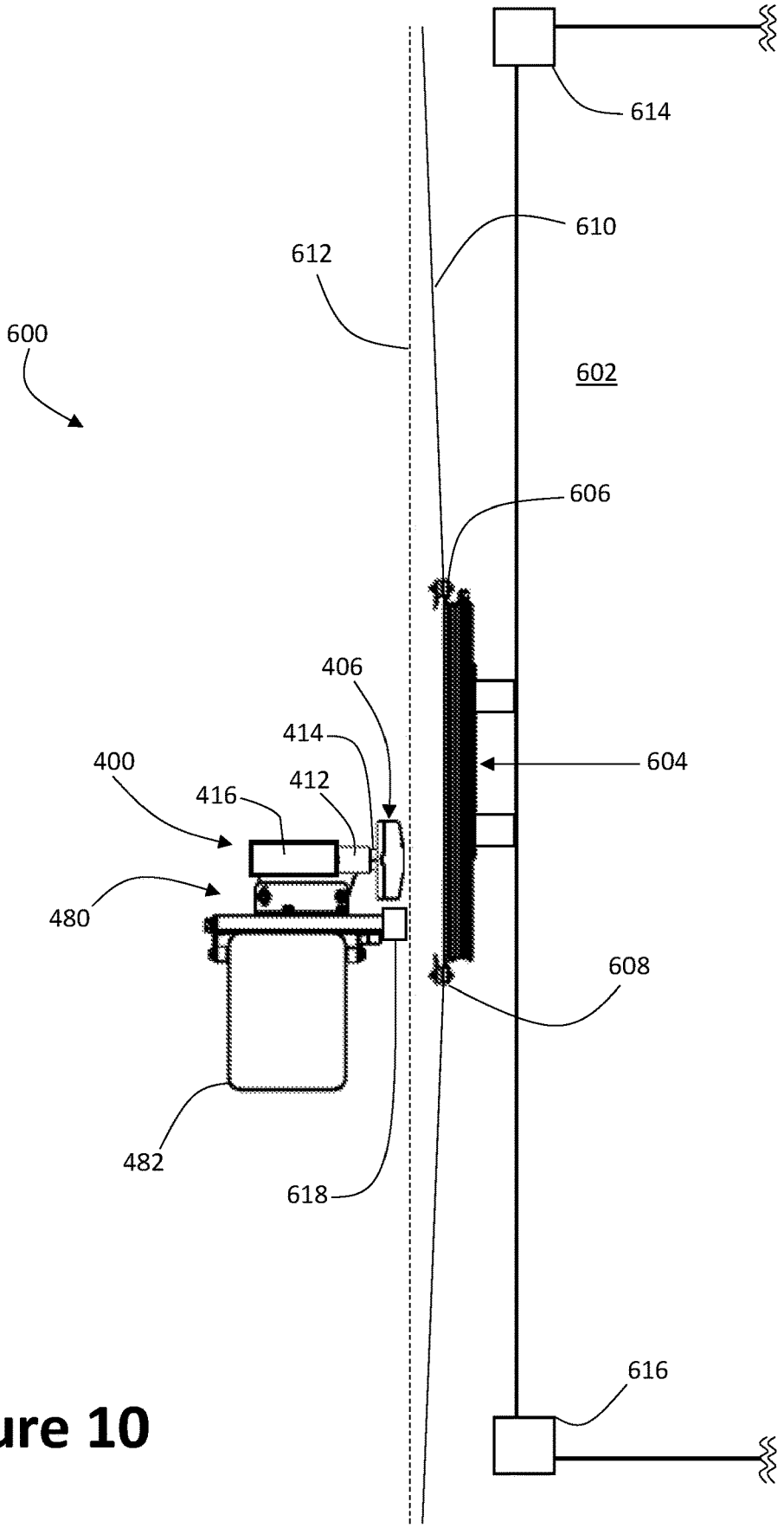
FIG. 10 is a side schematic view of another example stabilizing system that includes the stabilizing mechanism depicted in FIG. 9.

Unlike the example stabilizing mechanism 100 shown in FIGS. 1 and 2, though, the example stabilizing mechanism 400 in FIGS. 9 and 10 may include means 416 for selectively moving the telescoping member 414 between a retracted position and an extended position without any assistance from a roller cam disposed on an elevator cab. For example and without limitation, the means 416 may include an actuator such as a solenoid or pyrotechnic switch. The stabilizing mechanism 400 may thus be configured to retract the guide 406 away from the elevator cab and any sensors on the elevator cab as the elevator cab approaches the stabilizing mechanism 400. In the retracted position, the telescoping member 414 and the guide 406 are moved towards the mount 412. In the extended position, the telescoping member 414 and the guide 406 are moved away from the mount 412. To be clear, a degree of overlap between the mount 412 and the telescoping member 414 is greater in the retracted position than in the extended position.

FIG. 10 illustrates another example stabilizing system 600 and how the example stabilizing mechanism 400 may operate in some cases. Here, the example stabilizing mechanism 400 may be attached via an adjustable support 480 to a beam 482 that is fixed within a hoistway. As an elevator cab 602 approaches the stabilizing mechanism 400, the means 416 for selectively moving the telescoping member 414 may retract the telescoping member 414 into a retracted position as shown in FIG. 10 to avoid any contact between the stabilizing mechanism 400 and a sensor 604 or tape guides 606, 608 disposed on the elevator cab 602. In some instances, the telescoping member 414 may be retracted substantially or even entirely into the mount 412 in the retracted position. After the elevator cab 602 passes, the means 416 for selectively moving the telescoping member 414 may extend the telescoping member 414 into an extended position where the guide 406 once again partially surrounds and stabilizes tape 610 suspended in the hoistway. Even in the extended position, though, it may be the case that at least a portion of the telescoping member 414 remains within the mount 412. Those having ordinary skill in the art will appreciate that at least two mechanisms prevent contact between the stabilizing mechanism 400 and the components disposed on the elevator cab 602 as the elevator cab 602 passes: (i) retraction of the guide 406 and (ii) the tape guides 606, 608 pulling the tape 610 away from a tape plumb line 612.

In some examples, the stabilizing system 600 may employ sensors, motion sensors, optical sensors, lasers, magnets, and/or the like for detecting proximity of the elevator cab 602 relative to the stabilizing mechanism 400 and, ultimately, informing the means 416 when to selectively retract and extend the telescoping member 414. As merely one example, first and second magnets 614, 616 may be disposed on the elevator cab 602. A magnetic sensor 618 disposed on or adjacent to the stabilizing mechanism 400, the adjustable support 480, or the beam 482 may detect the presence and/or approach of the magnets 614, 616. In turn, a controller that is informed about the presence and/or approach of the magnets 614, 616 may instruct the means 416 to either retract or extend the telescoping member 414. The telescoping member may by default be disposed in an extended position so as to surround and stabilize the tape 610. As another example, an optical source/sensor could be mounted on the elevator cab, and two optical reflectors may be spaced, respectively, vertically above and below a stabilizing mechanism in the hoistway. When the elevator cab and the optical source/sensor passes a first of the optical reflectors, the means for selectively moving the telescoping member may cause the telescoping member to retract until the elevator cab and the optical source/sensor pass a second of the optical reflectors. Alternatively, the means for selectively moving the telescoping member may cause the telescoping member to retract only for a period of time after the optical source/sensor passes either of the optical reflectors, so long as the elevator cab continues moving as expected.

What is claimed is:

1. A stabilizing system comprising:

a stabilizing mechanism that is configured to be fixed within an elevator hoistway, the stabilizing mechanism including:

a telescoping member, a mount for the telescoping member, wherein the telescoping member is positionable in a retracted position and in an extended position relative to the mount, and a guide disposed on the telescoping member, the guide being configured to partially surround and stabilize tape suspended in the elevator hoistway when the telescoping member is in the extended position; and a roller cam that is configured to be disposed on an elevator cab, wherein the roller cam is configured to force the telescoping member from the extended position into the retracted position when the roller cam engages with the stabilizing mechanism.

2. The stabilizing system of claim 1 wherein the mount is a first tube and the telescoping member is a second tube, wherein the second tube is disposed at least partially within the first tube and is concentric with the first tube.

3. The stabilizing system of claim 1 comprising a spring that forces the telescoping member away from the mount and into the extended position when the stabilizing mechanism and the roller cam are disengaged.

4. The stabilizing system of claim 1 wherein the roller cam has an upper portion, a central portion, and a lower portion, wherein the central portion extends vertically and the upper and lower portions are disposed at obtuse angles relative to the central portion.

5. The stabilizing system of claim 4 wherein the roller cam comprises an open-ended slot disposed at each of a top and a bottom of the roller cam.

6. The stabilizing system of claim 1 comprising:

a tape guide disposed between a side of the elevator cab and the roller cam, wherein the tape guide is spaced horizontally apart from a plumb line of the tape that is suspended in the elevator hoistway; and a sensor for detecting indicia on the tape that identify vertical positions within the elevator hoistway, wherein the sensor is adjacent to the tape guide.

7. The stabilizing system of claim 1 wherein the guide comprises a U-shaped channel having two opposing flanges that are connected by a planar member, wherein the U-shaped channel is configured to limit sway of the tape within the elevator hoistway.

8. The stabilizing system of claim 1 wherein the stabilizing mechanism comprises a cam that is disposed on the guide, wherein the cam rolls along the roller cam when the stabilizing mechanism and the roller cam are engaged.

9. A stabilizing system for stabilizing tape suspended in an elevator hoistway, the stabilizing system comprising a stabilizing mechanism that includes:

a telescoping member;

a mount for the telescoping member, wherein the telescoping member is positionable in a retracted position and in an extended position relative to the mount, with the telescoping member being biased into the extended position; and a guide disposed on the telescoping member, the guide being configured to partially surround and stabilize the tape in the elevator hoistway when the telescoping member is in the extended position.

10. The stabilizing system of claim 9 comprising an adjustable support for fixing the stabilizing mechanism within the elevator hoistway.

11. The stabilizing system of claim 10 wherein the adjustable support is attached to the stabilizing mechanism with a fastener that extends through a slotted aperture so as to permit adjustment of a position of the stabilizing mechanism.

12. The stabilizing system of claim 9 wherein the telescoping member is forced into the retracted position when an elevator cab passes the stabilizing mechanism, wherein in the retracted position the guide is spaced horizontally apart from the tape.

13. The stabilizing system of claim 9 comprising a spring disposed at the mount, wherein the spring biases the telescoping member into the extended position.

14. The stabilizing system of claim 9 comprising:

a sensor disposed on an elevator cab and configured to detect indicia on the tape that signify positions within the elevator hoistway;

tape guides that are adjacent to the sensor, wherein the tape guides guide the tape for the sensor as the elevator cab travels in the elevator hoistway; and a roller cam that engages with the stabilizing mechanism and forces the telescoping member into the retracted position when the elevator cab passes the stabilizing mechanism, wherein the sensor is disposed between the roller cam and the elevator cab.

15. The stabilizing system of claim 14 wherein the guide comprises two opposing flanges that stabilize the tape in the elevator hoistway, wherein cams that are engageable with the roller cam are disposed on external sides of the two opposing flanges.

16. A stabilizing system for stabilizing tape suspended in an elevator hoistway, the stabilizing system comprising a stabilizing mechanism that includes:

a telescoping member;

means for selectively moving the telescoping member between a retracted position and an extended position; and a guide disposed on the telescoping member, the guide being configured to partially surround and stabilize the tape in the elevator hoistway when the telescoping member is in the extended position.

17. The stabilizing system of claim 16 wherein the means for selectively moving the telescoping member is configured to move the telescoping member into the retracted position when an elevator cab passes the stabilizing mechanism.

18. The stabilizing system of claim 17 comprising a sensor configured to determine proximity of the elevator cab relative to the stabilizing mechanism.

19. The stabilizing system of claim 16 wherein in the retracted position the guide is spaced horizontally apart from a sensor on the elevator that detects indicia on the tape.

20. The stabilizing system of claim 16 wherein in the retracted position the guide is spaced horizontally apart from a plumb line of the tape.

* * * * *